US005623873A

United States Patent [19]

Ikeda

[11] Patent Number: 5,623,873

[45] Date of Patent: Apr. 29, 1997

[54] OFFSET PRINTING PRESS

[75] Inventor: Naoki Ikeda, Fuchu, Japan

[73] Assignee: Ryobi Limited, Tokyo, Japan

[21] Appl. No.: 640,024

[22] Filed: Apr. 30, 1996

[30] Foreign Application Priority Data

Feb. 5, 1995 [JP] Japan ..... 7-108566

[51] Int. Cl.[6] ..... B41F 7/06; B41F 7/02

[52] U.S. Cl. ..... 101/137; 101/147; 101/148; 101/218; 101/247

[58] Field of Search ..... 101/132.5, 137, 101/139, 140, 144, 145, 147, 148, 247, 351, 352, 216, 218

[56] References Cited

U.S. PATENT DOCUMENTS

| | | | |
|---|---|---|---|
| 1,591,127 | 7/1926 | Harrold et al. | 101/137 |
| 2,821,911 | 2/1958 | Mestre | 101/144 |
| 2,845,860 | 8/1958 | Mestre | 101/137 |
| 3,477,367 | 11/1969 | Richards | 101/137 |
| 3,490,367 | 1/1970 | Kaneko et al. | 101/144 |
| 3,521,559 | 7/1970 | Sejeck et al. | 101/137 |
| 3,536,006 | 10/1970 | Roozee | 101/137 |
| 3,800,698 | 4/1974 | Kist et al. | 101/137 |
| 4,000,692 | 1/1977 | Wirz et al. | 101/148 |
| 4,676,156 | 6/1987 | Aylor et al. | 101/148 |
| 4,907,507 | 3/1990 | Ishii | 101/148 |

*Primary Examiner*—Eugene H. Eickholt
*Attorney, Agent, or Firm*—Brooks & Kushman P.C.

[57] ABSTRACT

An offset printing press comprises a plate cylinder onto which a printing plate is attached, a form dampening roller having an elasticity on its outer surface, a water fountain roller immersed into water in a water pan, and intermediate roller means for transferring the water from the water fountain roller to the form dampening roller. The intermediate roller means comprises a water oscillating roller which has a hydrophilic property on its outer surface and is capable of reciprocating in its axial direction with contacting the form dampening roller. Also, the offset printing press comprises first moving means for moving the form dampening roller close to and away from the plate cylinder; and second moving means for moving at least one of the water oscillating roller and the form dampening roller so that these two rollers can be moved close to and away from each other.

14 Claims, 13 Drawing Sheets

OFFSET PRINTING PRESS

BACKGROUND OF THE INVENTION

This invention relates to an offset printing press comprising a mechanism for moving at least one roller in a water supply portion close to and away from another roller therein.

In general, there is a well-known offset printing press in which water and ink are supplied to a printing plate attached onto the outer surface of a plate cylinder, and then they are transferred to a blanket cylinder, while printing sheets are fed between the blanket cylinder and an impression cylinder for printing.

The above offset printing press comprises a water supply portion and an ink supply portion, and the water supply portion comprises a forme dampening roller contacting the printing plate onto the plate cylinder, a water fountain roller immersed into water in a water pan, and intermediate roller means intervening between the water fountain roller and the forme dampening roller for transferring the water therebetween. The intermediate roller means comprises a water oscillating roller capable of reciprocating in its axial direction with contacting the forme dampening roller for leveling a thickness of water thereon. Such an offset printing press is disclosed, for example, in Japanese Patent Laid-Open Publication HEI1(1989)-280556.

In the above offset-printing press, if each of the water oscillating roller and the forme dampening roller has a hydrophilic property on each outer surface, it is no problem to contact these two rollers with each other at all times. However, if the water oscillating roller has a hydrophilic property on its outer surface, while the forme dampening roller has a lipophilic property on its outer surface, some troubles may be occurred while supplying water. For example, in case that the offset printing press is re-driven after a printing operation is once finished, water does not attach to the water oscillating roller, and thereby it is difficult to supply the water to the plate cylinder stably, since the ink on the forme dampening roller is transferred onto the water oscillating roller before the water is supplied thereon. Therefore, an operator of the offset printing press must wipe off the ink from the water oscillating roller before re-driven the offset printing press, and this work makes the printing operation troublesome.

SUMMARY OF THE INVENTION

One of the objects of the present invention is to provide an offset printing press capable of preventing ink adherence to a water oscillating roller thereby to save the trouble for a printing operation.

To achieve the above object, an offset printing press of the present invention comprises a plate cylinder onto which a printing plate is attached, a forme dampening roller having an elasticity on its outer surface, a water fountain roller immersed into water in a water pan, and intermediate roller means for transferring the water from the water fountain roller to the forme dampening roller. The intermediate roller means comprises a water oscillating roller which has a hydrophilic property on its outer surface and is capable of reciprocating in its axial direction with contacting the forme dampening roller. Also, the offset printing press comprises first moving means for moving the forme dampening roller close to and away from the plate cylinder; and second moving means for moving at least one of the water oscillating roller and the forme dampening roller so that these two rollers can be close to and away from each other.

According to the above offset printing press, when the offset printing press is driven, it is possible to contact the forme dampening roller and the water oscillating roller with each other after covering the outer surface of the water oscillating roller with the water supplied from the water fountain roller, and therefore if the ink adheres to the outer surface of the forme dampening roller, there is no fear that the ink transfers to the outer surface of the water oscillating roller. Accordingly, it is possible to supply the plate cylinder with the water certainly, and thereby an operator of the offset printing press does not have to wipe the water oscillating roller before the offset printing press is driven.

Another object of the present invention is to provide an offset printing press which can move a water oscillating roller, a forme dampening roller and a plate cylinder close to and away from each other with a simple operation.

To achieve the above object, an offset press comprises a plate cylinder onto which a printing plate is attached, a forme dampening roller having an elasticity on its outer surface, a water fountain roller immersed into water in a water pan, and intermediate roller means for transferring the water from the water fountain roller to the forme dampening roller. The intermediate roller means comprises a water oscillating roller which has a hydrophilic property on its outer surface and is capable of reciprocating in its axial direction with contacting the forme dampening roller. Also, the offset press comprises a common operation member for accepting operation, a first mechanism for moving the forme dampening roller close to and away from the plate cylinder in accordance with operation of the common operation member; and a second mechanism for moving at least one of the water oscillating roller and the forme dampening roller so that these two rollers can be moved close to and away from each other in accordance with operation of the common operation member.

According to the above offset printing press, it is possible to contact and detach the water oscillating roller, the forme dampening roller and the plate cylinder each other by only operating the common operation member. Therefore, the operation of the offset printing press is facilitated, and structure for contacting the rollers each other is simplified. Also, it is possible to prevent ink adherence to the water oscillating roller, because the water oscillating roller and the forme dampening roller moves close to and away from each other in accordance with operation of the second mechanism.

Still another object of the present invention is to provide an offset printing press which can contact a forme dampening roller, a water oscillating roller and a plate cylinder each other in predetermined order and can simplify structure of the offset printing press.

To achieve the above object, an offset printing press comprises a plate cylinder onto which a printing plate is attached, a forme dampening roller having an elasticity on its outer surface, a water fountain roller immersed into water in a water pan, and intermediate roller means for transferring the water from the water fountain roller to the forme dampening roller. The intermediate roller means comprises a water oscillating roller which has a hydrophilic property on its outer surface and is capable of reciprocating in its axial direction with contacting the forme dampening roller. The forme dampening roller is supported by supporting means so that it can move close to and away from each of the plate cylinder and the water oscillating roller. Also, the offset press comprises a common operation member, a first mechanism for converting operation of the common operation member into a first motion in which the forme dampening roller moves close to and away from the plate cylinder; and a second conversion mechanism for converting operation of the common operation member into a second motion in which the forme dampening roller moves close to and away from the water oscillating roller. The operation member, the first mechanism and the second mechanism are so associated with each other that the forme dampening roller can contact the plate cylinder after contacting the water oscillating roller, when the common operation member is operated in one direction.

According to the above offset printing press, when the operation member is operated in one direction, first the forme dampening roller contacts the water oscillating roller, and then it contacts the plate cylinder. In this case, since the forme dampening roller can move away from the water oscillating roller, it is possible to cover the water oscillating roller with the water supplied from the water fountain roller before the forme dampening roller contacts the water oscillating roller. After this, the water can be transferred to the forme dampening roller and the plate cylinder by only operating the operation member in one direction. Further, since the forme dampening roller is supported so as to move close to and away from each of the plate cylinder and the water oscillating roller, it is not necessary to move the water oscillating roller in its radial direction. Therefore, the structure of the offset printing press is more simplified.

Further objects, features and other aspect of this invention will be understood from the following detailed description of the preferred embodiments of this invention with reference to the drawings.

DESCRIPTION OF THE PREFERRED EMBODIMENTS

Some preferred embodiments of the present invention will now be explained with reference to the drawings.

Figure 1:
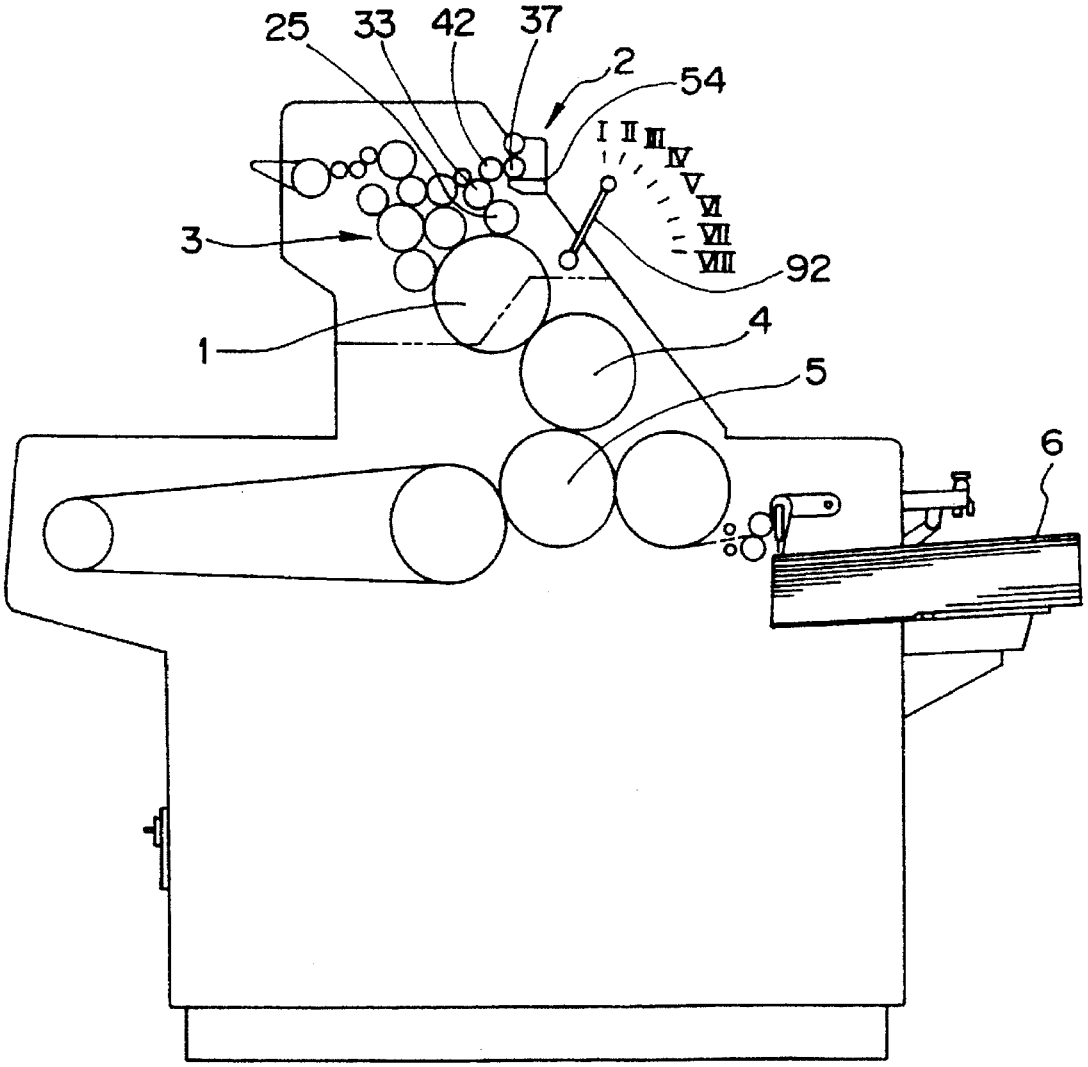
FIG. 1 is a simplified vertical sectional view of an offset printing press in accordance with one embodiment of the present invention.

As shown in FIG. 1, an offset printing press of this embodiment comprises a plate cylinder 1 onto which a printing plate (not shown) is attached, a water supply portion 2 and an ink supply portion 3. The plate cylinder 1 is in contact with a blanket cylinder 4, and the blanket cylinder 4 is in contact with an impression cylinder 5. When in the printing operation, a printing sheet 6 passes between the blanket cylinder 4 and the impression cylinder 5.

Figure 2:
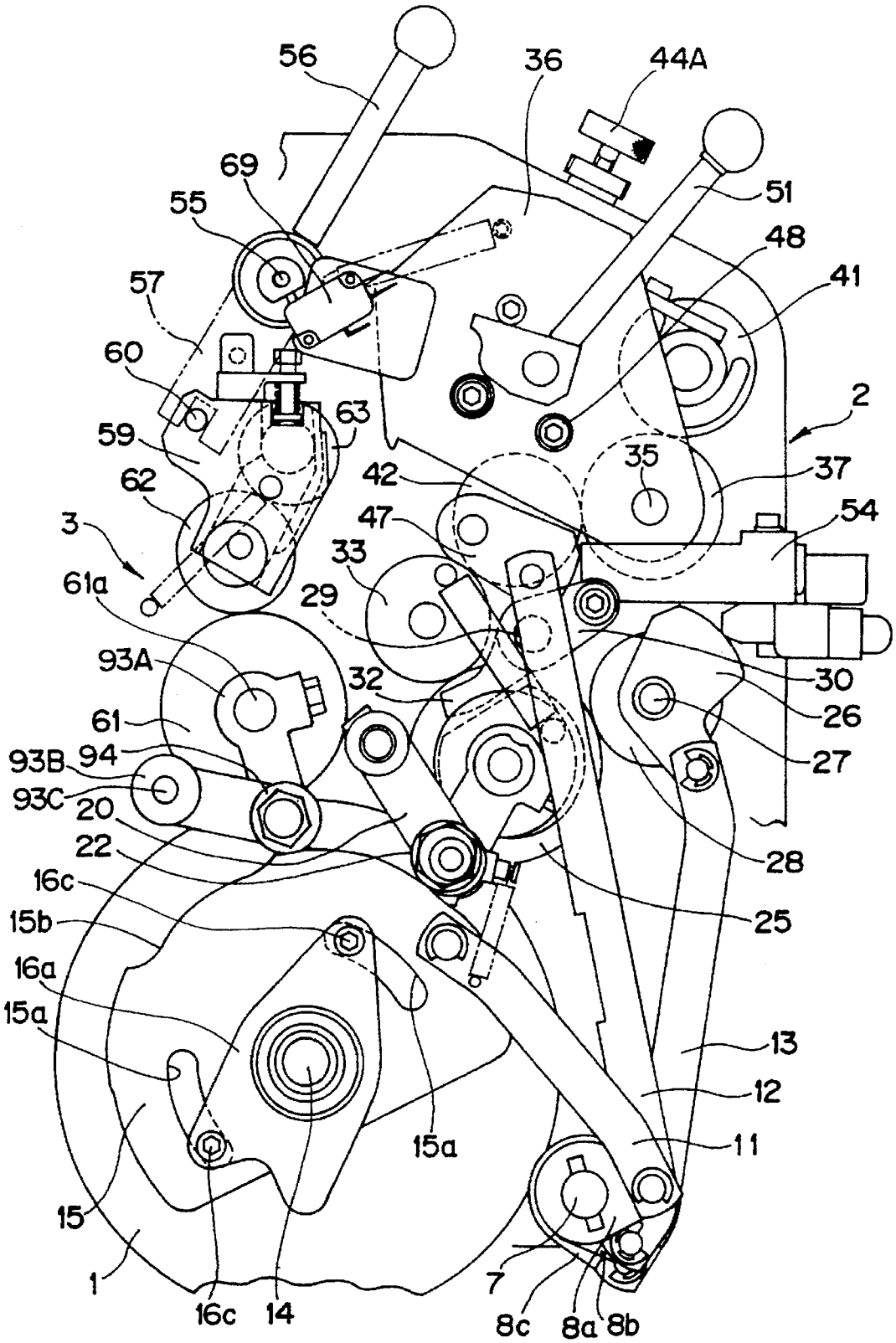
FIG. 2 is a partial enlarged view showing a plate cylinder, a water supply portion and an ink supply portion disclosed in FIG. 1.
Figure 3:
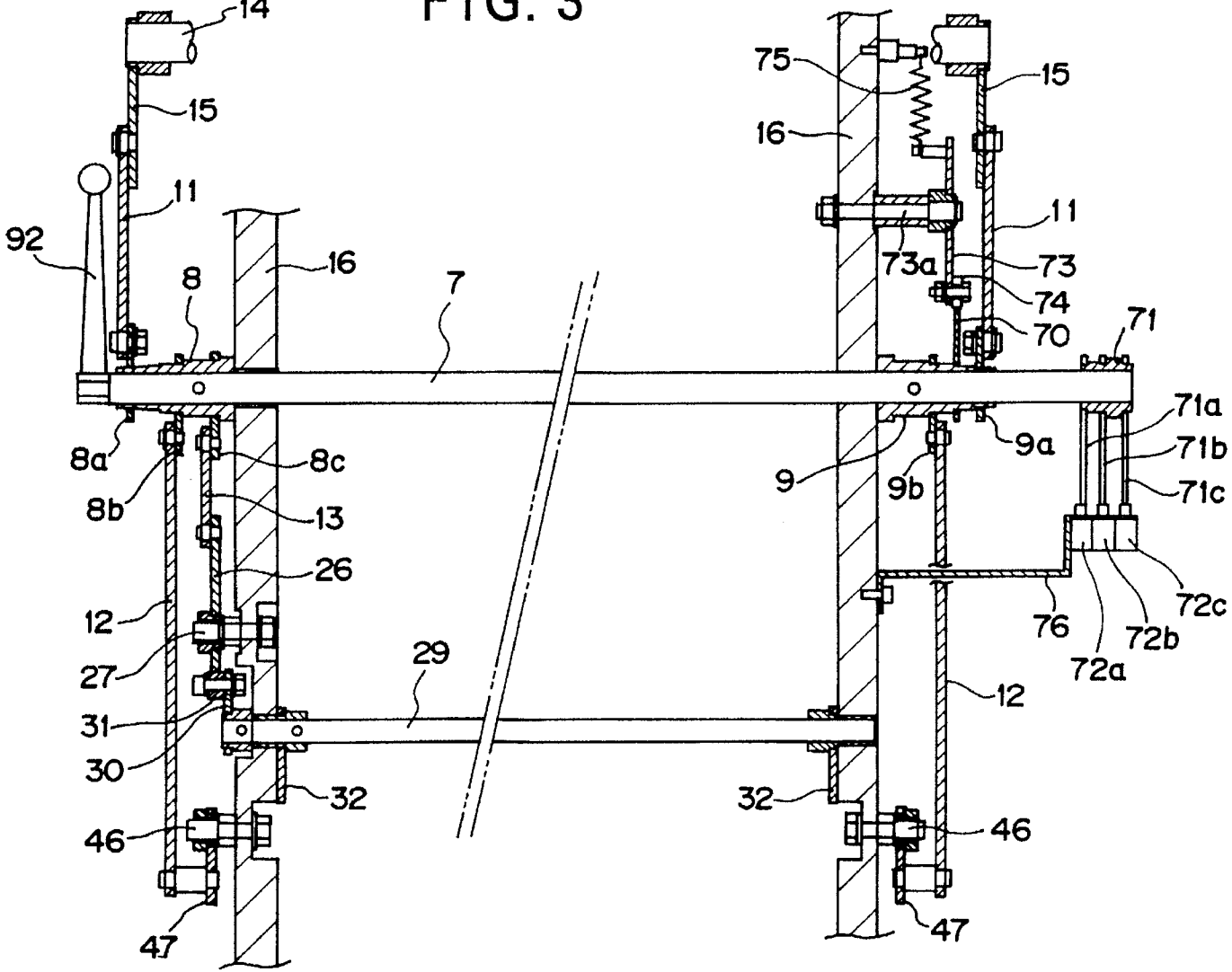
FIG. 3 is a partial cross-sectional view of the offset printing press showing a structure for driving cam plates in accordance with operation of an operation lever.
Figure 6:
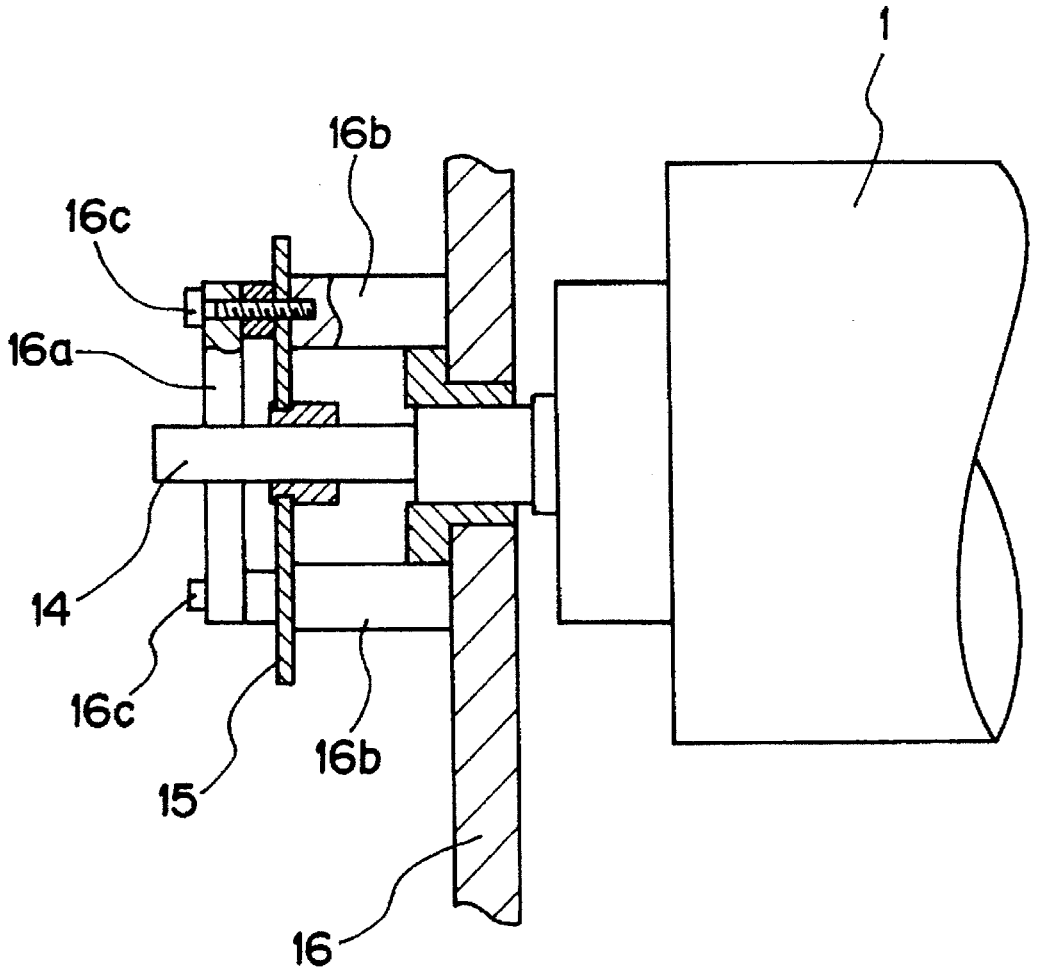
FIG. 6 is a partial sectional view of the offset printing press showing a mechanism for supporting the plate cylinder.

As shown in FIGS. 2 and 3, an operation shaft 7 is provided between two ink frames 16, each of which is extending vertically and parallel to each other, and an operation lever 92 is fixed to one end thereof (refer to FIG. 1). Collars 8 and 9, each of which is located near the outer side of the ink frame 16, are coaxially fixed on the operation shaft 7 so that they can rotate together with the shaft 7. The collar 8 is equipped with three arm plates 8*a*, 8*b* and 8*c*, and these arm plates 8*a*, 8*b*, and 8*c* are pivotally connected with link plates 11, 12, and 13, respectively. On the other hand, the collar 9 is equipped with two arm plates 9*a* and 9*b*, and these arm plates 9*a* and 9*b* are pivotally connected with other link plates 11 and 12, respectively. Each link plate 11 is pivotally connected with a cam plate 15 (only one of which is shown in FIGS. 2 and 6).

Between the ink flames 16, 16 is provided a plate cylinder shaft 14 (not shown in FIGS. 3 through 5), and the plate cylinder 1 is coaxially and rotatably supported thereon. Referring to FIGS. 2 and 6, the cam plate 15 is attached to each end of the plate cylinder shaft 14. The cam plate 15 is rotatable about the plate cylinder shaft 14 within a predetermined angle which is determined by the length of two elongated holes 15*a*, 15*a*. Namely, an end plate 16*a* is mounted on each ink frame 16 by screwing bolts 16*c*, 16*c* into two support rods 16*b*, 16*b* fixed to the ink frame 16. Each bolt 16*c* is inserted into each hole 15*a* to restrict the rotational angle of the cam plate 15 as mentioned above.

A cam follower 94 as a roller is provided on the cam surface of the cam plate 15. The cam follower 94 is pivotally connected with each one end of two arms 93A, 93B. The other end of the arm 93A is connected with the center shaft 61*a* of an ink forme roller 61, while the other end of the arm 93B is pivotally connected with the ink frame 16 via a pin 93C. Therefore, when the operation shaft 7 is rotated, the cam follower 94 moves up and down to move the ink forme roller 61 away from and close to the plate cylinder 1.

Figure 4:
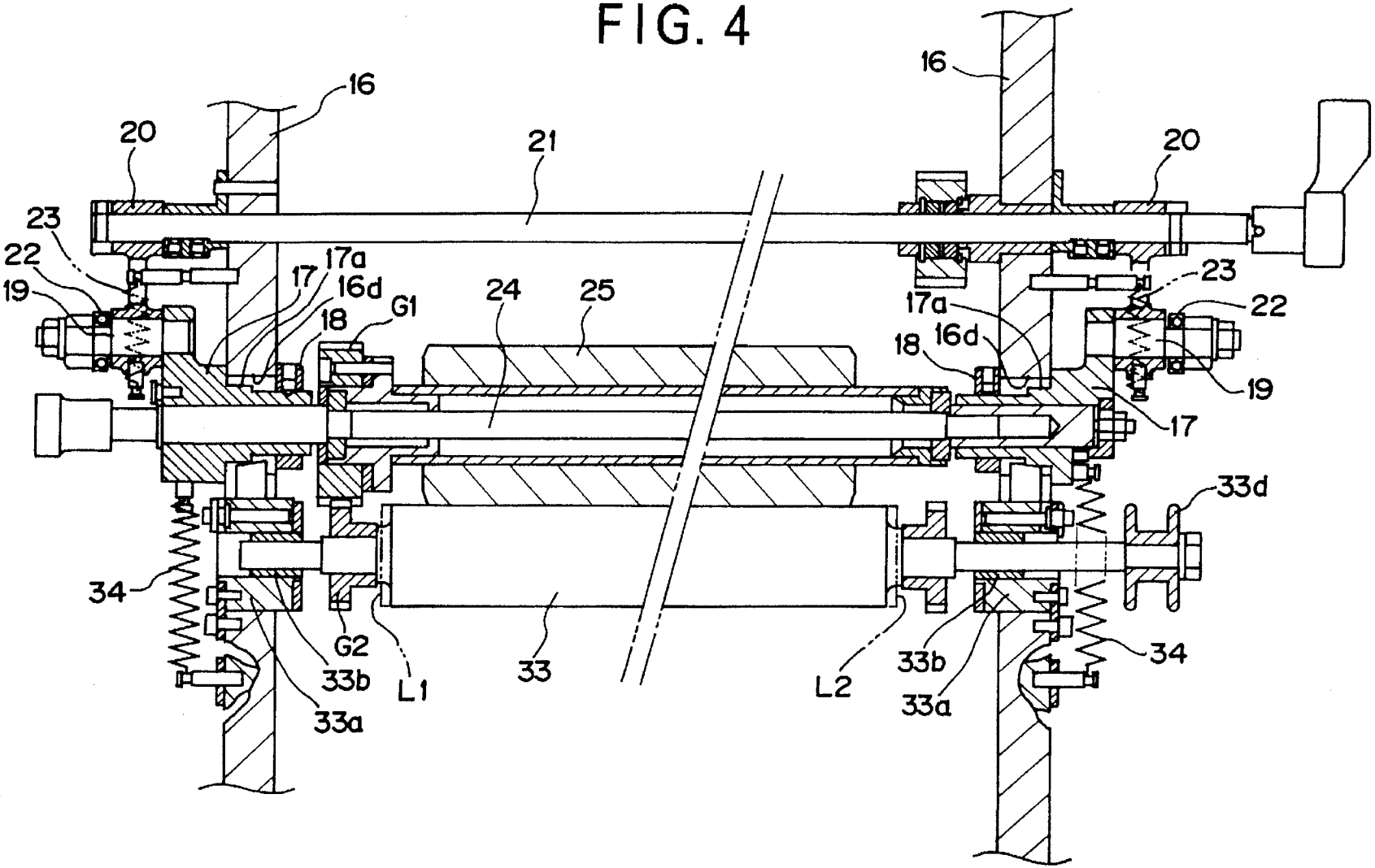
FIG. 4 is another partial cross-sectional view of the offset printing press showing a structure for supporting a forme dampening roller and a water oscillating roller.
Figure 7:
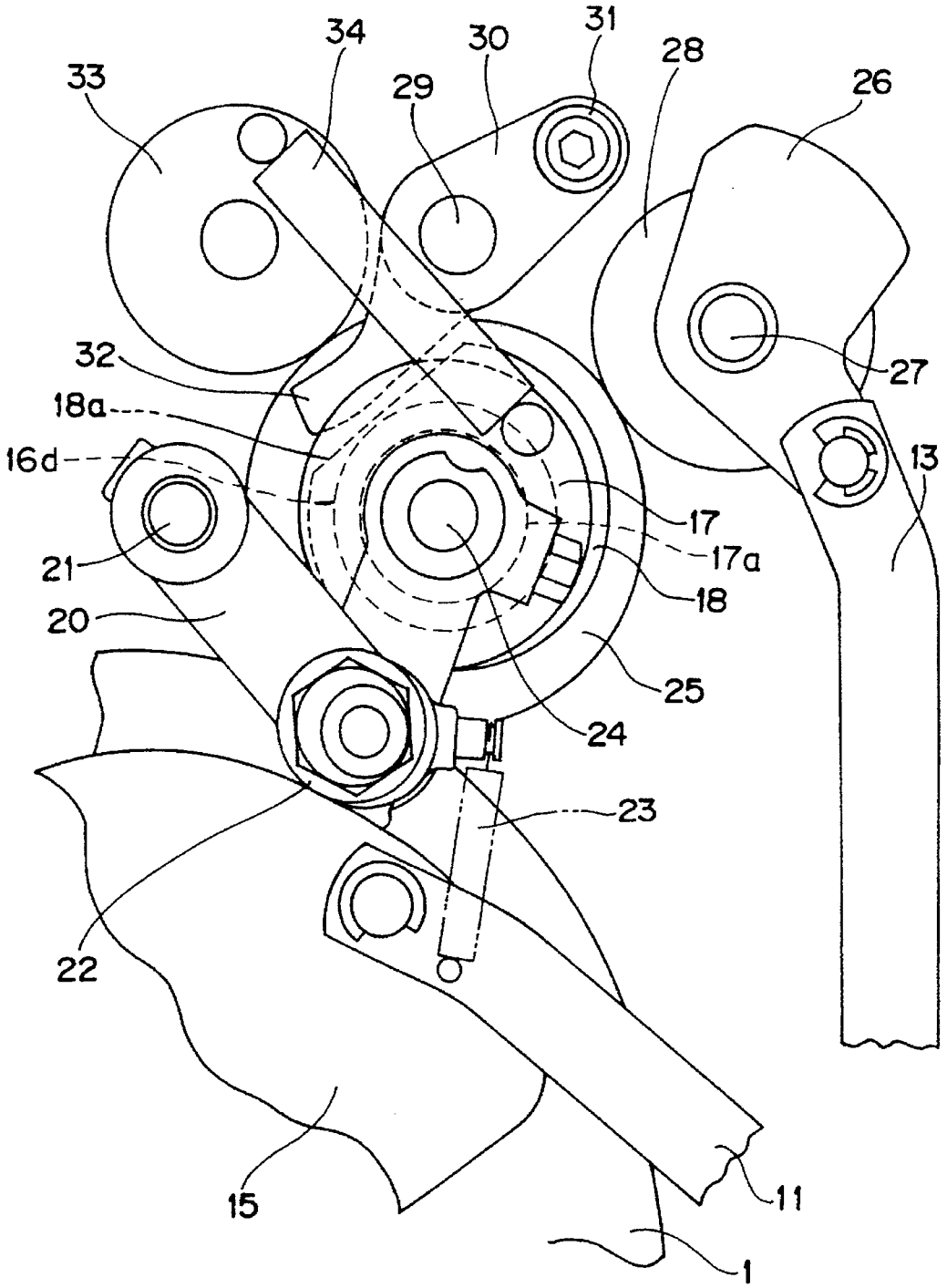
FIG. 7 is a partial enlarged view of the water supply portion showing a structure for moving the forme dampening roller close to and away from the water oscillating roller and the plate cylinder.

Referring to FIGS. 2, 4 and 7, a holder 17 is attached to each ink frame 16 (not shown in FIG. 7). Each holder 17 is connected with a collar 18, and therefore, the holder 17 is restrained in its axial direction (right-and-left direction in FIG. 4). The holder 17 is equipped with a pin 19 which is pivotally connected with one end of an arm 20. The other end of the arm 20 is connected with the support shaft 21 which is bridged between the ink frames 16, 16. Also, a roller bearing 22 is attached to each pin 19.

As illustrated in FIGS. 4 and 7, the arm 20 is connected with one end of a coil spring 23, the other end of which is connected with the ink frame 16, and thereby the roller bearing 22 is urged to contact the outer surface of the cam plate 15 by the tension force of the coil spring 23. A roller shaft 24 is bridged between the two holders 17, 17, and a forme dampening roller 25 is coaxially provided thereon. The forme dampening roller 25 has an elasticity on its outer surface. The outer circumference of the forme dampening roller 25 is, for example, made by a rubber to obtain such an elasticity. The holder 17 is loosely inserted into a hole 16*d* of the ink frame 16, so that it can move in its radial direction. In other words, the diameter of the hole 16*d* is set greater than that of an inserted portion 17*a* of the holder 17. Accordingly, the forme dampening roller 25 can move close to and away from the plate cylinder 1 and is urged to contact the plate cylinder 1 due to the spring force of the coil spring 23.

As shown in FIGS. 3 and 7, the link plate 13 is pivotally connected with a cam plate 26 which is rotatable about a pin 27 fixed to the ink frame 16. A water rider oscillating roller 28 is brought into contact with the forme dampening roller 25. A shaft 29 is provided between the two ink frames 16, 16 so as to rotate about its axis. The shaft 29 is connected, at one end thereof, with a first arm 30. At the tip portion of the first arm 30 is provided a roller 31 which is capable of contacting the cam plate 26 in accordance with the rotation of the cam plate 26. Also, two second arms 32, 32, each of which is disposed on the inner surface of the frame 16, are attached to the shaft 29 so that it can rotate therewith.

Since the holder 17 is loosely inserted into the hole 16*d* of the ink frame 16, the forme dampening roller 25 can also move close to and away from a water oscillating roller 33. When the cam plate 26 is rotated in the counter clockwise direction in FIG. 7, the cam plate 26 contacts the roller 31 to thereby push the first arm 30 so as to rotate about the axis of the shaft 29 in the counter clockwise direction. Therefore, each second arm 32 is rotated so as to contact a flat portion 18*a* of each collar 18 to move the forme dampening roller 25 away from the water oscillating roller 33. The water oscillating roller 33 has a hydrophilic property on its outer surface. In order to obtain such a property, the outer surface of the water oscillating roller 33 is, for example, plated with chromium.

As shown in FIGS. 4 and 7, the water oscillating roller 33 is supported by slide bushes 33*b*, 33*b* held in holders 33*a*, 33*a* (not shown in FIG. 7), each of which is mounted onto the ink frame 16, and thereby the water oscillating roller 33 is slidable in an axial direction while contacting the forme dampening roller 25 as illustrated by imaginary lines L1 and L2 in FIG. 4. Such a slide motion of the water oscillating roller 33 is effective for leveling or making uniform the thickness of the water film surrounding the forme dampening roller 25.

The water oscillating roller 33 is coupled with an engagement member 33*d* at its one end, and the engagement member 33*d* is engaged with a reciprocating drive mechanism (not shown in the figures) for reciprocating the water oscillating roller 33 in the axial direction. The two rollers 25 and 33 are urged to contact each other by the tension force of coil springs 34, 34, each of which is bridged between the holders 17 and 33*a*. Gears 61 and 62 are coupled with the rollers 25 and 33, respectively, for transmitting the rotational movement therebetween.

Figure 5:
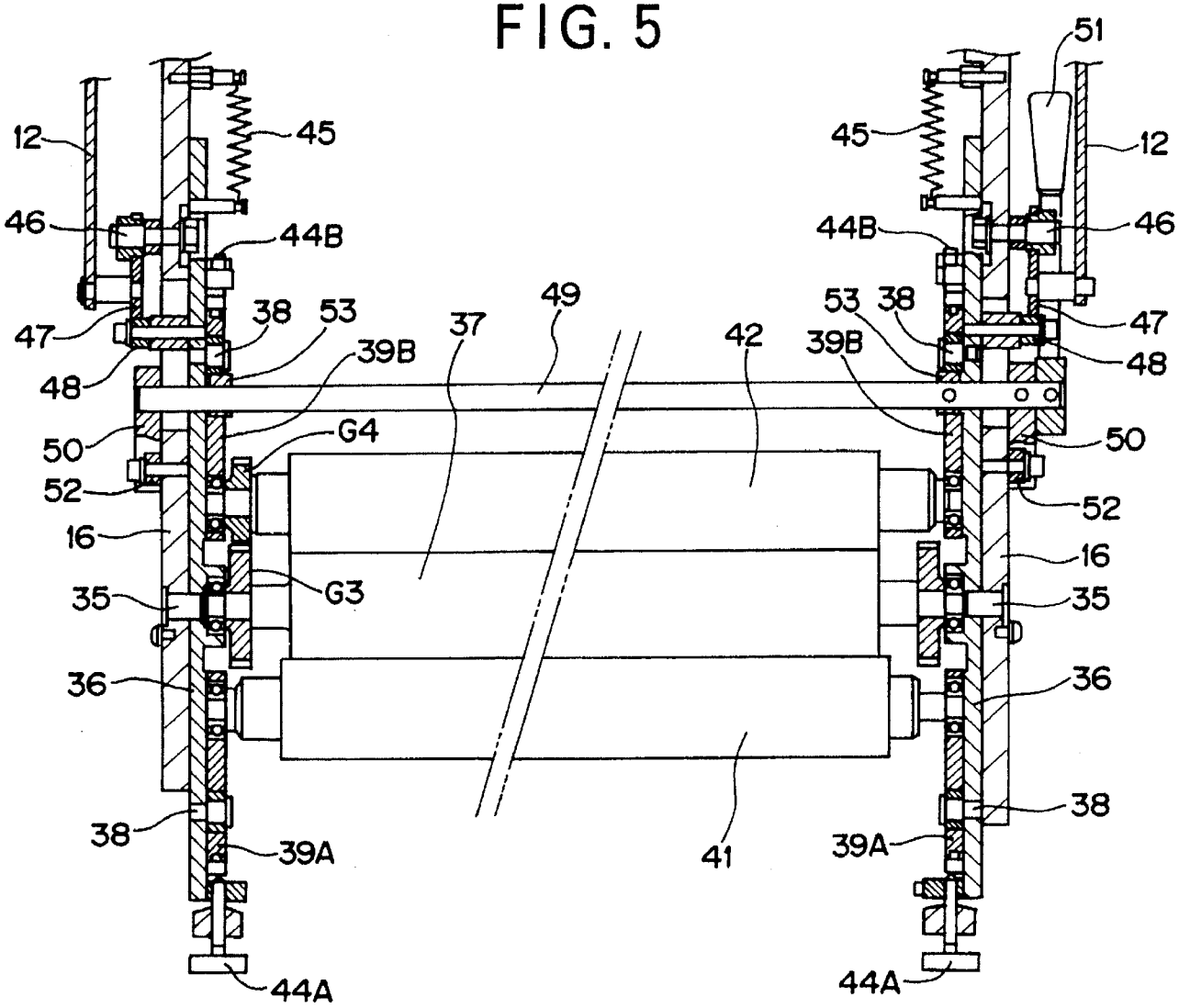
FIG. 5 is a further partial cross-sectional view of the offset printing press showing a structure for supporting a water fountain roller, a water transfer roller and an amount adjusting roller.
Figure 8:
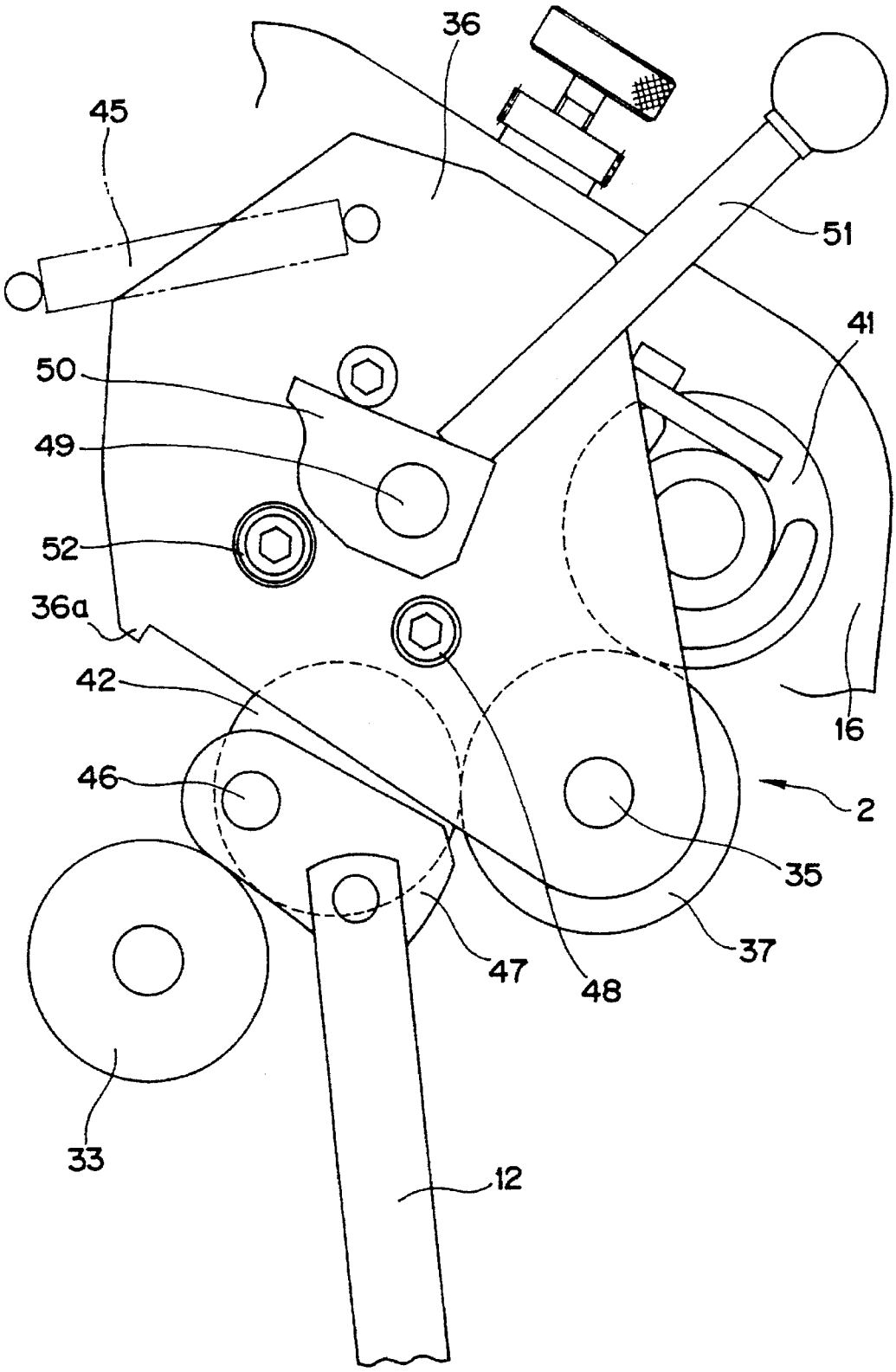
FIG. 8 is another partial enlarged view of the water supply portion showing a structure for moving the water transfer roller close to and away from the water oscillating roller.
Figure 9:
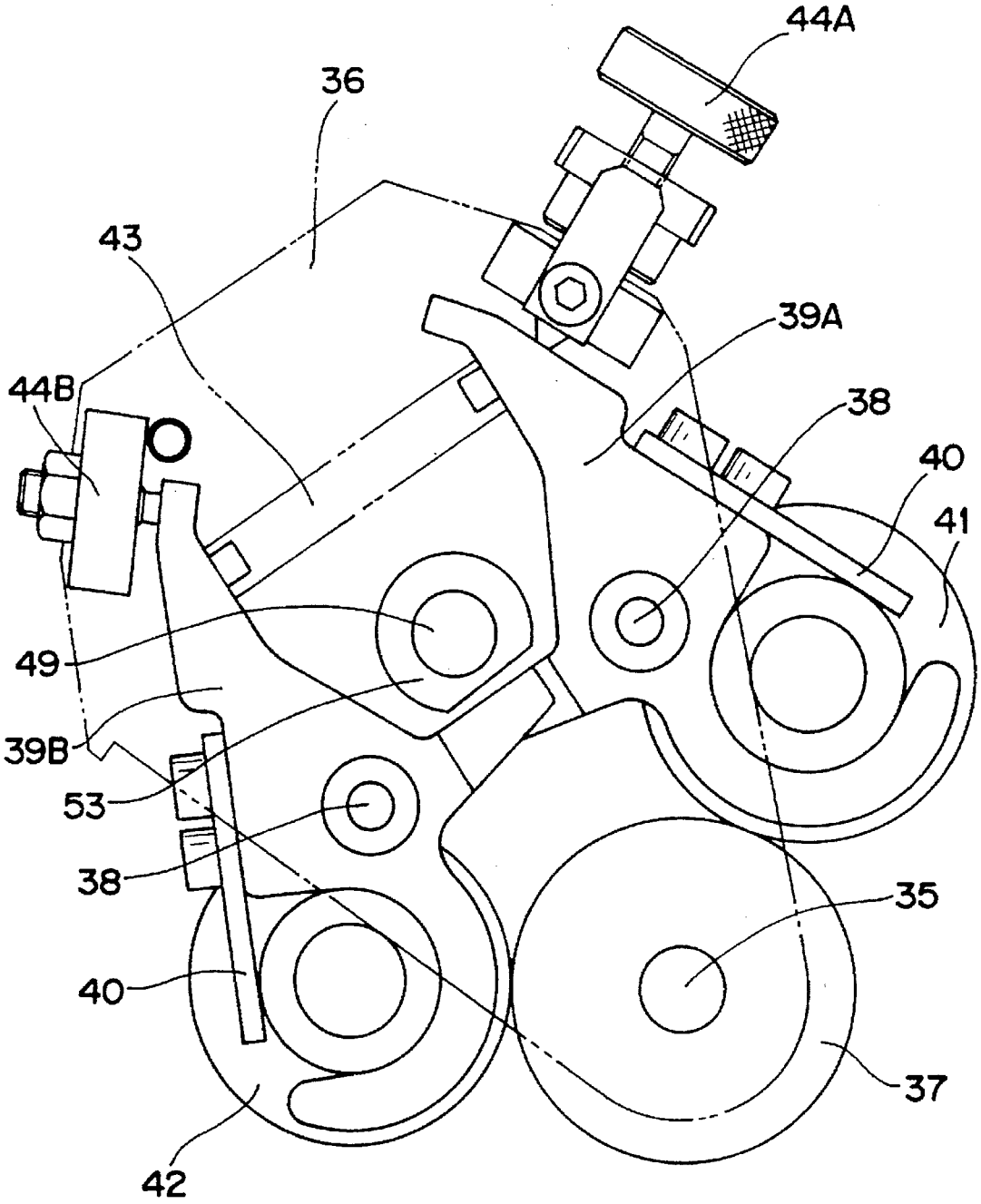
FIG. 9 is a further partial enlarged view of the water supply portion showing a structure for moving the water transfer roller close to and away from the water fountain roller.

Referring to FIGS. 5 and 8, a water frame 36 is pivotally mounted on each ink frame 16 via a pin 35. A water fountain roller 37 is coaxially provided with the pin 35 and is immersed into water in a water pan 54 (refer to FIG. 2). As shown in FIGS. 5 and 9, each water frame 36 is equipped with a pair of arms 39A and 39B, each of which is rotatable about a pin 38 and is opposite to each other. An amount adjusting roller 41 is bridged between the arms 39A, 39A, while a water transfer roller 42 is bridged between the arms 39B, 39B. Each of the rollers 41 and 42 is held by a holding member 40 bolted on each of the arms 39A and 39B.

The amount adjusting roller 41 and the water transfer roller 42 can move close to and away from the water fountain roller 37 in accordance with the swinging motions of the arms 39A and 39B about pins 38, 38. Also, the two rollers 41 and 42 are urged to contact the water fountain roller 37 by a coil spring 43 provided between the arms 39A and 39B. The arms 39A and 39B are brought into contact with pressure adjusting screws 44A and 44B, respectively. Each of the adjusting screws 44A and 44B is supported by the water frame 36 so as to be capable of adjusting its position in the axial direction thereof. Therefore, each pressing force of the rollers 41 and 42 with respect to the water fountain roller 37 is adjusted in accordance with each position of the adjusting screws 44A and 44B.

The water transfer roller 42 can also move close to and away from the water oscillating roller 33 in accordance with the rotation of the water frame 36 about the pin 35. Also, the water transfer roller 42 is urged to contact the water oscillating roller 33 by coil springs 45, 45 provided between the ink frames 16 and the water frames 36 ( refer to FIG. 5).

As shown in FIGS. 3, 5 and 8, each ink frame 16 is equipped with a cam plate 47 rotatable about a pin 46, and each link plate 12 is pivotally connected with each cam plate 47. When the cam plate 47 is rotated about the pin 46 in the counter clockwise direction in FIG. 8, the cam plate 47 is brought into contact with a roller 48 mounted on the water frame 36. In this state, the water frame 36 can not rotate in the counter clockwise direction in FIG. 8, thereby to keep the water transfer roller 42 away from the water oscillating roller 33.

Between the water frames 36, 36 is bridged a shaft 49, each end of which is connected with a cam plate 50. The shaft 49 is rotatable about its axis by operating a lever 51 which is fixed to one end of the shaft 49. Each cam plate 50 is rotatable about the axis of the shaft 49. When the cam plate 50 is rotated so as to contact a pin 52 fixed to the ink frame 16, the water frame 36 is rotated in the clockwise direction in FIG. 8 about the pin 35.

Referring to FIGS. 5 and 9, cam blocks 53, 53, each of which corresponds to each pair of the arms 39A and 39B, are provided on the shaft 49. Each cam block 53 is capable of moving close to and away from the arms 39A and 39B in accordance with the rotation of the shaft 49. When the cam block 53 contacts the arms 39A and 39B, these arms 39A and 39B rotate in opposite directions against the force of the coil spring 43, to thereby move the amount adjusting roller 41 and the water transfer roller 42 away from the water fountain roller 37. As shown in FIG. 5, the water fountain roller 37 and the water transfer roller 42 are coupled with gears G3 and G4, respectively, for transmitting the rotation therebetween. The water fountain roller 37 is rotated by a motor (not shown in the figures).

Figure 10:
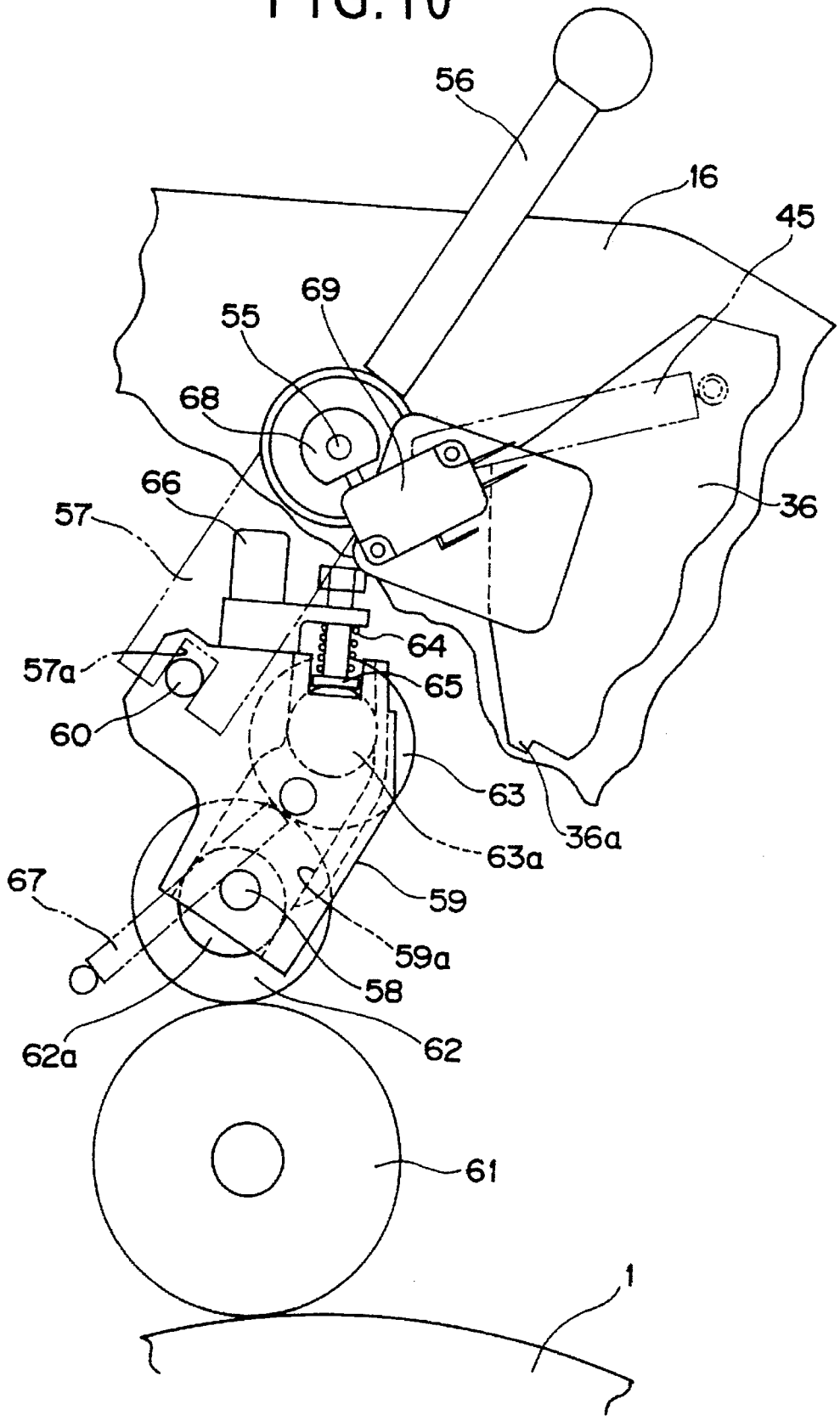
FIG. 10 is a partial enlarged view showing the ink supply portion.

As shown in FIGS. 2 and 10, a shaft 55 is provided between the ink frames 16. The shaft 55 is coupled with a detaching lever 56 and an arm 57. The arm 57 has a recess 57*a*, to receive a pin 60 mounted on a bracket 59. The bracket 59 is pivotally supported by the ink frame 16 via a pin 58, and accordingly, the bracket 59 is rotated about the pin 58 in response to the operation of the lever 56. The bracket 59 has a groove 59*a* into which support portions 62*a* and 63A of an ink distributor roller 62 and an ink transfer roller 63 are inserted. The ink distributor roller 62 contacts the ink forme roller 61, and the ink transfer roller 63 contacts the ink distributor roller 62. The bracket 59 supports a push member 65 so that it can move up and down. The push member 65 is urged to contact the support portion 63*a* by a coil spring 64, so that the ink transfer roller 63 is urged to contact with the ink distributor roller 62.

The bracket 59 is combined with a cam plate 66. When the bracket 59 is rotated about the pin 58 in the clockwise direction in FIG. 10 by operating the lever 56, the water frame 36 is pushed by the cam plate 66 so as to be rotated about the pin 35 in the clockwise direction in FIG. 8, and then a hook portion 36*a* of the water frame 36 is engaged with the cam plate 66, thereby to keep the connection between the water frame 36 and the bracket 59. In this condition, the water transfer roller 42 is kept away from the water oscillating roller 33.

As shown in FIGS. 2 and 10, the bracket 59 is urged to rotate in the counter clockwise direction by a tension force of a coil spring 67 which is bridged between the bracket 59 and the ink frame 16. When the cam plate 66 and the hook portion 36*a* are released from each other, the bracket 59 is returned in the position illustrated in FIGS. 2 and 10. On the shaft 55 is provided a switch cam 68 which turns on and off a switch 69 for detecting the position of the bracket 59 about the pin 58.

Figure 11:
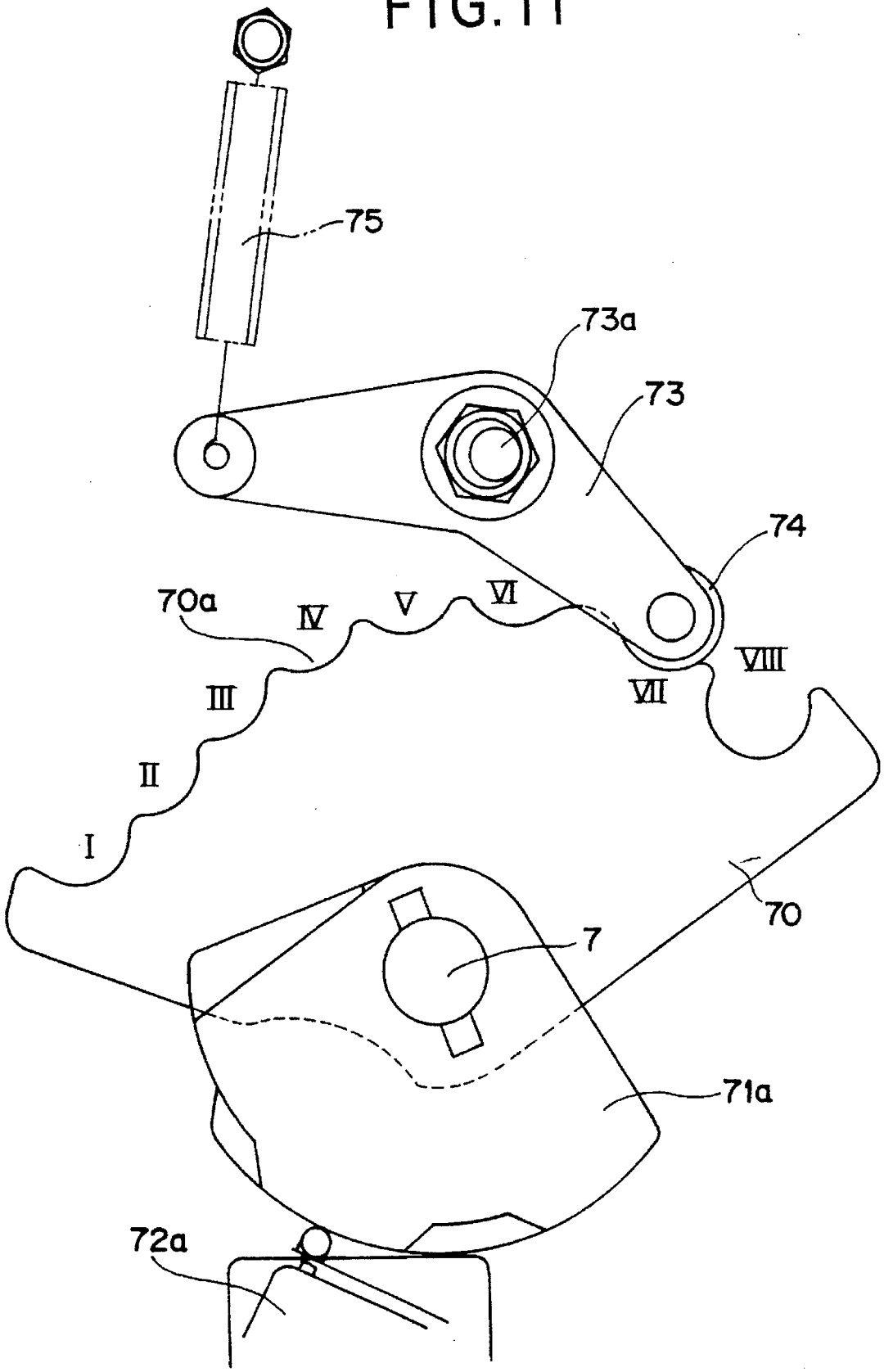
FIG. 11 is a partial enlarged view showing a mechanism for locating the operation shaft.

Referring to FIGS. 3 and 11, a locating cam plate 70 which has a corrugated cam surface 70*a* is attached to the collar 9, and a collar 71 which is equipped with three switch cam plates 71*a*, 71*b* and 71*c* is attached to the end of the operation shaft 7. The cam surface 70*a* of the cam plate 70 contacts a roller 74 attached to one end of a lever 73. The lever 73 is mounted on the ink frame 16 via a pin 73*a* and is pivotable about the pin 73*a*. The other end of the lever 73 is connected with one end of a coil spring 75, the other end of which is connected with the ink frame 16. Accordingly, the lever 73 is urged to rotate in the clockwise direction in FIG. 11 about the pin 73*a*, and therefore, the roller 74 is pushed onto the cam surface 70*a* and is stopped at one of positions I through VIII thereon in accordance with the rotation of the operation shaft 7. Note that the operational lever 92 is located one of positions I through VIII by engaging the roller 74 with the cam surface 70*a* of the cam plate 70, and the positions I through VIII illustrated in FIG. 11 correspond to positions I through VIII of the operation lever 92 illustrated in FIG. 1, respectively.

As shown in FIG. 3, the switch cam plates 71*a*, 71*b* and 71*c* correspond to switches 72*a*, 72*b* and 72*c* respectively, and each of the switches 72*a*, 72*b* and 72*c* is turned on and off by each of the switch cam plates 71*a*, 71*b* and 71*c* in accordance with the rotation of the operation shaft 7. A controller of the offset printing press (not shown in the figures) controls some devices or mechanisms in the offset printing press, for example, a motor for rotating the water fountain roller 37, a suction pump of a suction foot, a paper feeding mechanism or the like, in accordance with the out put signals from the switches 72*a*, 72*b* and 72*c*. The switches 72*a*, 72*b* and 72*c* are supported by a bracket 76 fixed to the ink frame 16.

According to the above structure, each of the cam plates 15, 26 and 47 is rotated in accordance with the rotation of the operation shaft 7. The forme dampening roller 25 is moved close to and away from the plate cylinder 1 in accordance with the rotation of the cam plate 15. Also, the roller 25 is moved close to and away from the water oscillating roller 33 in accordance with the rotation of the second arm 32, and the second arm 32 is rotated in accordance with the rotation of the cam plate 26. Further, the water transfer roller 42 is moved close to and away from the water oscillating roller 33 in accordance with the rotation of the water frame 36 about the pin 35, and the water frame 36 is rotated in accordance with the rotation of the cam plate 47. Therefore, it is possible to control the contacting and detaching actions of the rollers 25 and 42 with respect to the plate cylinder 1 and the water oscillating roller 33 by operating the common operation lever 92. Further, it is possible to obtain desirable timings of each contacting and detaching actions by adjusting, for example, each profile of the cam plates 15, 26 and 47. One preferable adjusting will be shown in the following explanation.

Figure 12:
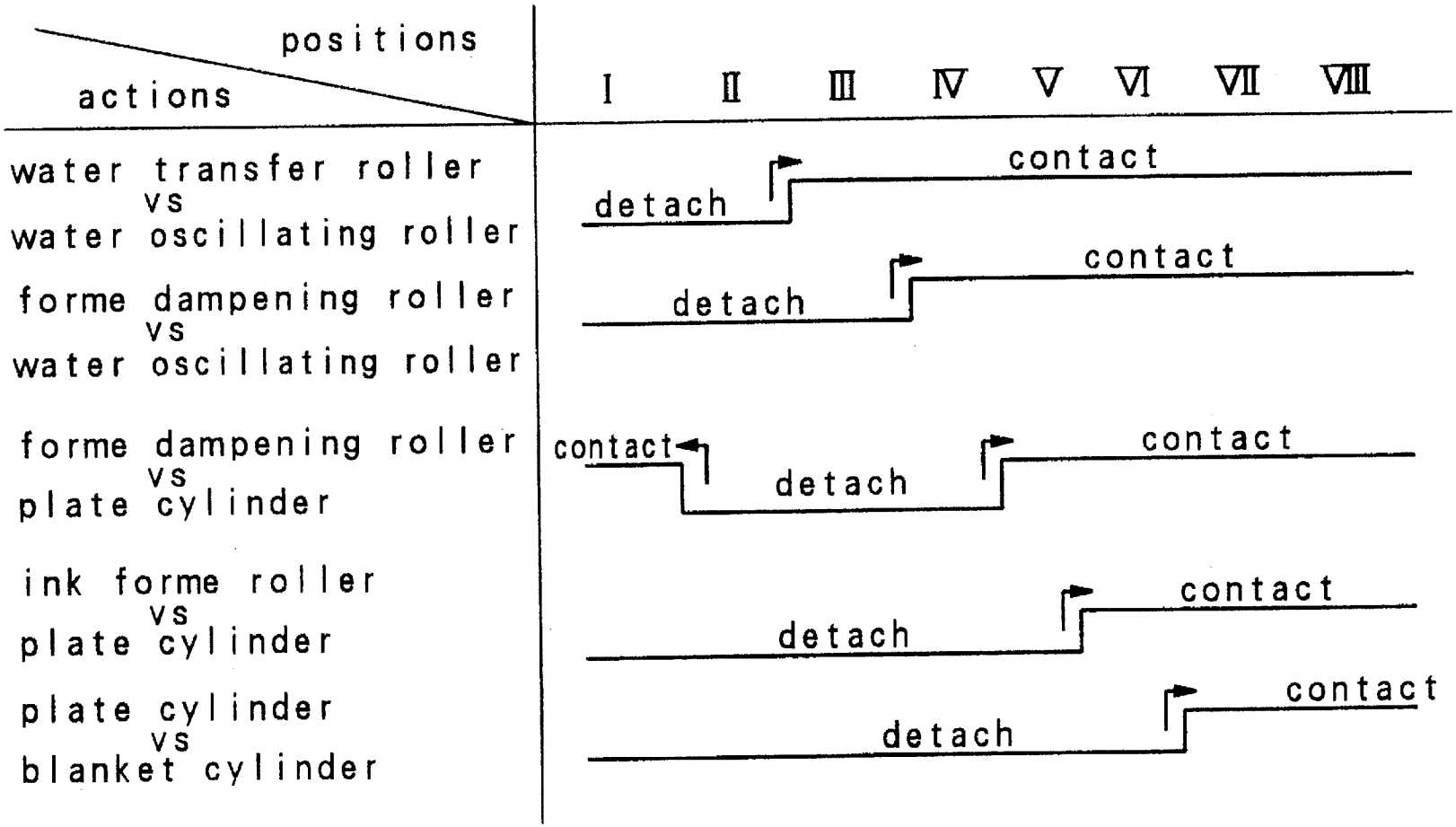
FIG. 12 is a diagram showing relations between positions of the operation lever and acitions of each rollers.

Now, the operation for starting printing of the above offset printing press will be explained with reference to FIG. 12. Note that the positions I trough VIII in FIG. 12 correspond to the positions I trough VIII in FIG. 1, respectively.

In case of strating the printing operation, first, the operation lever 92 is rotated from the position II to the positon III. In response to this rotaition, the cam plates 47 rotates about the pin 46 in the clockwise direction in FIG. 8, so that it detaches from the roller 48, and threfore, the water frame 36 rotates about the pin 35 in the counter clockwise direcition in FIG. 8 due to the force of the coil spring 45. As a result, the water transfer roller 42 contacts the water oscillating roller 33, and thereby the water in the water pan 54 is supplied from the water fountain roller 37 to the water oscillating roller 33 via the water transfer roller 42 in accordance with rotations of these rollers 37, 42 and 33.

Next, the operation lever 92 is rotated from the position III to the position IV. Then, the cam plate 26 rotates about the pin 27 in the clockwise direction in FIG. 7, so that it detaches from the roller 31 as shown in FIG. 7. Therefore, the first arm 30, the shaft 29 and the second arm 32 can freely rotate about the axis of the shaft 29 in the clockwise direction in FIG. 7, and then the forme dampening roller 25 moves so as to contact the water oscillating roller 33 due to the force of the coil spring 34. As a result, the water is transferred from the water oscillating roller 33 to the forme dampening roller 25. At the same time, the water oscillating roller 33 is reciprocatingly moved in the axial direction to level the thickness of the water film on the forme dampening roller 25.

Further, the operation lever 92 is rotated from the position IV to the position V. Then, the cam plate 15 rotates about the axis of the forme cylinder shaft 14 in the clockwise direction in FIG. 2 so that the roller bearing 22 falls into a lower portion 15*b* thereon (refer to FIG. 2), and therefore the form dampening roller 25 contacts the plate cylinder 1 with keeping contact the water oscillating roller 33, thereby to supply the water to the plate cylinder 1.

After supplying water, the operation lever 92 is rotated from the position V to the position VI. Then, the ink forme roller 61 (refer to FIG. 2) contacts the plate cylinder 1 in accordance with actions of the arms 93A, 93B and the cam follower 94, to thereby supply the ink to the printing plate on the plate cylinder 1.

Next, the operation lever 92 is rotated from the position VI to the position VII. Then, the plate cylinder 1 contacts the blanket cylinder 4 (refer to FIG. 1), to transfer images onto the outer surface of the blanket cylinder 4. Further, the operation lever 92 is rotated from the position VII to the position VIII. Then, the printing sheet 6 is fed between the blanket cylinder 4 and the impression cylinder 5, to transfer the images to the printing sheet 6.

As mentioned above, since the forme dampening roller 25 and the water oscillating roller 33 can move close to and away from each other, it is possible to contact the forme dampening roller 25 and the water oscillating roller 33 each other after covering the outer surface of the water oscillating roller 33 with the water by contacting the water transfer roller 42 and the water oscillating roller 33 each other. Therefore, the water oscillating roller 33 is kept away from the ink on the forme dampening roller 25, and the water is reliably supplied to the plate cylinder 1.

Next, the operation for attaching the printing plate onto the plate cylinder 1 will be explained.

In this operation, the operation lever 92 is rotated from the position II to the position I. Then, each of the cam plates 47, 15 and 26 rotates in the counter clockwise direction in FIG. 2. However, at this time, the water transfer roller 42 , the water oscillating roller 33 and the forme dampening roller 25 are kept away from each other as indicated in FIG. 12, because the rollers 48 and 31 ride on the cam plates 47 and 26, respectively, while the operation lever 92 moves between the positions I and II. On the contrary, when the operation lever 92 is located at the position I, the roller bearing 22 falls into the lower portion 15*b* on the cam plate 15 (refer to FIG. 2), and therefore, the forme dampening roller 25 contacts the plate cylinder 1 due to the spring force of the coil spring 23. In this condition, it is possible to attach the printing plate onto the plate cylinder 1 with pushing the printing plate by the forme dampening roller 25. Note that, at this time, because the forme dampening roller 25 and the water oscillating roller 33 are kept away from each other, the ink does not adhere onto the water oscillating roller 33. Accordingly, it is not necessary to wipe the water oscillating roller 33 after the printing plate is attached to the plate cylinder 1, and therefore the efficiency of the operation is improved.

In the above embodiment, it is possible to rotate the operation shaft 7 by an actuator such as a motor or the like, instead of manually operating the operation lever 92. Hereafter, another embodiment in which the shaft 7 is driven by an actuator will be explained with reference to FIG. 13. Note that FIG. 13 only shows a structure different from the above embodiment, and accordingly, explanations in common with the above will be omitted from the followings.

Figure 13:
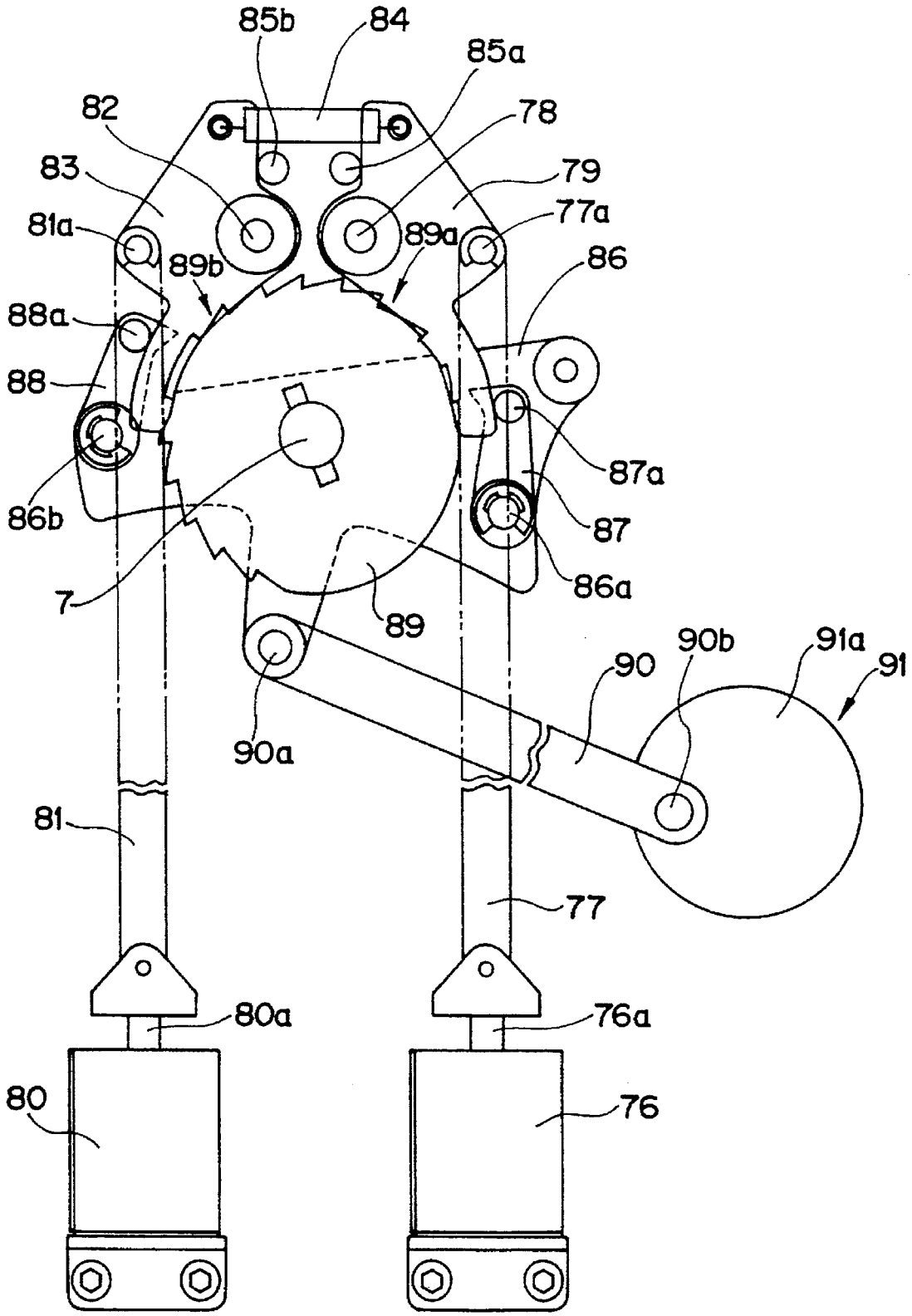
FIG. 13 is a partial enlarged view showing a mechanism for driving the operation shaft of another embodiment.

As shown in FIG. 13, the offset printing press comprises a solenoid actuator 76 in which a rod 76*a* is driven in the axial direction thereof by turning on and off the electromagnet (not shown in FIG. 13) housed therein. The rod 76*a* is coaxially connected with one end of a link 77, and the other end of the link 77 is pivotally connected with a lever 79 via a pin 77*a*. The lever 79 is pivotally mounted on the ink frame 16 (refer to FIGS. 1 through 3) via a pin 78. The offset printing press also comprises a solenoid actuator 80 which has the same construction as that of the solenoid actuator 76. A rod 80*a* thereof is coaxially connected with one end of a link 81. The other end of the link 81 is pivotally connected with a lever 83 via a pin 81*a*. The lever 83 is also pivotally mounted on the ink frame 16 via a pin 82.

Between the levers 79 and 83 is provided a coil spring 84, to urge the lever 79 so as to rotate about the pin 78 in the counter clockwise direction in FIG. 13, while the lever 83 is urged to rotate about the pin 82 in the clockwise direction therein. Rotations of these levers 79 and 83 are restricted by pins 85*a* and 85*b*, respectively.

An arm plate 86 is mounted on the operation shaft 7 so as to rotate freely with respect to the shaft 7. The arm plate 86 is equipped with feeding hooks 87 and 88 which can rotate about pins 86*a* and 86*b*, respectively. The feeding hook 87 is urged to rotate about the pin 86*a* in the counter clockwise direction by a spring (not shown), while the feeding hook 88 is urged to rotate about the pin 86*b* in the clockwise direction by another spring (also not shown). Pins 87*a* and 88*a* are attached to the feeding hooks 87 and 88, respectively, and each of the pins 87*a* and 88*a* contacts each of the levers 79 and 83. Therefore, the rotations of the feeding hooks 87 and 88 are restricted, respectively.

Also, a ratchet wheel 89 is coaxially mounted on the operation shaft 7 so that it can rotate therewith. The arm plate 86 is pivotally connected with one end of a link 90 via a pin 90*a*, the other end of which is pivotally connected with an output shaft 91*a* of a motor 91 via a pin 90*b*. Therefore, the arm plate 86 is swung about the shaft 7 within a predetermined angle every time the output shaft 91*a* makes one revolution. The solenoid actuators 76 and 80, and the motor 91 may be mounted on the ink frame 16.

In this embodiment, if it is necessary to rotate the operation shaft 7 in the counter clockwise direction in FIG. 13, the solenoid actuator 76 is actuated to pull the link 77 downwardly. Therefore, the lever 79 rotates about the pin 78 in the clockwise direction in FIG. 13, thereby to rotate the feeding hook 87 about the pin 86*a* in the counter clockwise direction to engage with a teeth portion 89*a* of the ratchet wheel 89. After this, the motor 91 is actuated, so that the arm plate 86 swings about the shaft 7, and therefore, the ratchet wheel 89 is rotated by the feeding hook 87, to rotate the shaft 7 in the counter clockwise direction.

On the contrary, in case that it is necessary to rotate the operation shaft 7 in the clockwise direction in FIG. 13, the solenoid actuator 80 is actuated to pull the link 81 downwardly. Therefore, the lever 83 rotates about the pin 82 in the counter clockwise direction in FIG. 13, thereby to rotate the feeding hook 88 about the pin 86*b* in the clockwise direction to engage with a teeth portion 89*b* of the ratchet wheel 89. After this, the motor 91 is actuated, and therefore, the ratchet wheel 89 is rotated by the feeding hook 88. As a result, the shaft 7 is rotated in the clockwise direction.

Note that if the offset printing press is a type of multicolor printing press, it is possible to provide each color section with the above mechanism disclosed in FIG. 13. The shaft 7 may be driven by, instead of the motor 91, another actuator of the offset printing press, for example, a motor for rotating the water fountain roller 37.

What is claimed is:

1. An offset printing press comprising:

a plate cylinder onto which a printing plate is attached;

a forme dampening roller having an elasticity on its outer surface;

a water fountain roller immersed into water in a water pan;

intermediate roller means for transferring the water from the water fountain roller to the forme dampening roller, the intermediate roller means comprising a water oscillating roller which has a hydrophilic property on its outer surface and is capable of reciprocating in its axial direction with contacting the forme dampening roller;

first moving means for moving the forme dampening roller close to and away from the plate cylinder; and second moving means for moving at least one of the water oscillating roller and the forme dampening roller so that these two rollers can be moved close to and away from each other.

2. The offset printing press of claim 1, further comprising means for associating the first moving means and the second moving means with each other so that the forme dampening roller contacts the plate cylinder after the water oscillating roller and the forme dampening roller contact each other.

3. The offset printing press of claim 1, further comprising means for associating the first moving means and the second moving means with each other so that the forme dampening roller can move close to and away from the plate cylinder with keeping the water oscillating roller away from the forme dampening roller.

4. An offset printing press comprising:

a plate cylinder onto which a printing plate is attached;

a forme dampening roller having an elasticity on its outer surface;

a water fountain roller immersed into water in a water pan;

intermediate roller means for transferring the water from the water fountain roller to the forme dampening roller, the intermediate roller means comprising a water oscillating roller which has a hydrophilic property on its outer surface and is capable of reciprocating in its axial direction with contacting the forme dampening roller;

a common operation member;

a first mechanism for moving the forme dampening roller close to and away from the plate cylinder in accordance with operation of the common operation member; and a second mechanism for moving at least one of the water oscillating roller and the forme dampening roller so that these two rollers can be moved close to and away from each other in accordance with operation of the common operation member.

5. The offset printing press of claim 4, wherein the operation member, the first mechanism and the second mechanism are so associated with each other that the forme dampening roller can contact the plate cylinder after the water oscillating roller and the forme dampening roller contact each other, when the common operation member is operated in one direction.

6. The offset printing press of claim 5, wherein the operation member, the first mechanism and the second mechanism are so associated with each other that the forme dampening roller can contact the plate cylinder while the forme dampening roller and the water oscillating roller are kept away from each other, when the common operation member is operated in the opposite direction of the one direction.

7. The offset printing press of claim 4, wherein the operation member, the first mechanism and the second mechanism are so associated with each other that the forme dampening roller can move close to and away from the plate cylinder while the forme dampening roller and the water oscillating roller are kept away from each other, when the common operation member is operated within a predetermined range.

8. The offset printing press of claim 4, further comprising a lever for manually operating the operation member.

9. The offset printing press of claim 4, further comprising an actuator for driving the operation member.

10. The offset printing press of claim 4, wherein the intermediate roller means further comprises a water transfer roller intervening between the water fountain roller and the water oscillating roller;

the offset printing press further comprises a third mechanism for moving at least one of the water transfer roller and the water oscillating roller so that these two rollers can be moved close to and away from each other in accordance with operation of the common operation member; and the operation member, the first mechanism, the second mechanism and the third mechanism are so associated with each other that first the water transfer roller and the water oscillating roller contact each other, next the water oscillating roller and the forme dampening roller contact each other, and then the forme dampening roller contact the plate cylinder, when the common operation member is operated in one direction.

11. The offset printing press of claim 4, further comprising an ink forme roller for transferring ink to the plate cylinder, the ink forme roller being moved close to and away from the plate cylinder by the first mechanism in accordance with operation of the operation member.

12. An offset printing press comprising:

a plate cylinder onto which a printing plate is attached;

a forme dampening roller having an elasticity on its outer surface;

a water fountain roller immersed into water in a water pan;

intermediate roller means for transferring the water from the water fountain roller to the forme dampening roller, the intermediate roller means comprising a water oscillating roller which has a hydrophilic property on its outer surface and is capable of reciprocating in its axial direction with contacting the forme dampening roller;

supporting means for supporting the forme dampening roller so that it can move close to and away from each of the plate cylinder and the water oscillating roller;

a common operation member;

a first mechanism for convening operation of the common operation member into a first motion in which the forme dampening roller moves close to and away from the plate cylinder; and a second conversion mechanism for converting operation of the common operation member into a second motion in which the forme dampening roller moves close to and away from the water oscillating roller, wherein the operation member, the first mechanism and the second mechanism are so associated with each other that the forme dampening roller can contact the plate cylinder after contacting the water oscillating roller, when the common operation member is operated in one direction.

13. The offset printing press of claim 12, wherein the operation member, the first mechanism and the second mechanism are so associated with each other that the forme dampening roller can contact the plate cylinder while being kept away from the water oscillating roller, when the common operation member is operated in the opposite direction of the one direction.

14. The offset printing press of claim 12, wherein each of the first mechanism and the second mechanism comprises a cam member operated together with the operation member, and the cam follow member capable of contacting the cam member and moving the forme dampening roller.

* * * * *